US007069700B2

(12) United States Patent
Heissenberg

(10) Patent No.: US 7,069,700 B2
(45) Date of Patent: Jul. 4, 2006

(54) SYSTEM FOR COVERING HURRICANE PANEL STUDS

(76) Inventor: Michael Heissenberg, 725 NE. Bayberry La., Jensen Beach, FL (US) 34957

( * ) Notice: Subject to any disclaimer, the term of this patent is extended or adjusted under 35 U.S.C. 154(b) by 334 days.

(21) Appl. No.: 10/137,290

(22) Filed: May 3, 2002

(65) Prior Publication Data

US 2002/0162286 A1 Nov. 7, 2002

Related U.S. Application Data

(60) Provisional application No. 60/288,648, filed on May 4, 2001.

(51) Int. Cl.
*E06B 3/30* (2006.01)

(52) U.S. Cl. ..... 52/202; 49/57; 49/463

(58) Field of Classification Search ..... 52/202, 52/203, 718.04, 287.1, 204.69, 204.62, 506.01, 52/506.05, 288.1, 717.01; 49/57, 463
See application file for complete search history.

(56) References Cited

U.S. PATENT DOCUMENTS 938,768 A * 11/1909 Kenny ..... 52/220.1
1,813,525 A * 7/1931 Astrup ..... 160/77
2,012,388 A 8/1935 Goodman
2,641,018 A * 6/1953 Snyder ..... 16/356
2,890,853 A * 6/1959 D'Azzo ..... 248/273
3,478,804 A * 11/1969 Meixner ..... 157/13
3,825,023 A * 7/1974 Bergeron ..... 135/120.3
3,991,806 A * 11/1976 Abell ..... 160/90
4,066,285 A * 1/1978 Hall et al. ..... 293/120
4,215,517 A 8/1980 Everson
4,321,780 A * 3/1982 Hooper et al. ..... 52/461
4,399,640 A * 8/1983 Porter ..... 52/202
4,425,744 A * 1/1984 Villareal ..... 52/169.14
4,561,223 A * 12/1985 Gold et al. ..... 52/202
4,620,503 A 11/1986 Pullens
4,634,172 A * 1/1987 Duda ..... 296/163
RE32,509 E * 9/1987 Werner ..... 52/202
4,693,042 A * 9/1987 Villarreal ..... 52/169.14
4,726,153 A * 2/1988 Adler et al. ..... 52/63
4,733,510 A * 3/1988 Werner ..... 52/202
4,941,524 A * 7/1990 Greer ..... 160/67
5,096,753 A * 3/1992 McCue et al. ..... 428/31
5,220,951 A * 6/1993 Dagenais ..... 160/199
5,253,457 A * 10/1993 Orth ..... 52/202
5,335,452 A 8/1994 Taylor
5,345,716 A * 9/1994 Caplan ..... 49/61
5,353,571 A * 10/1994 Berdan et al. ..... 52/716.5
5,430,982 A * 7/1995 Bane ..... 52/202
5,437,322 A * 8/1995 Murray ..... 160/61
5,549,148 A * 8/1996 Figueiredo et al. ..... 160/183

(Continued)

*Primary Examiner*—Robert Canfield
(74) *Attorney, Agent, or Firm*—Wenderoth, Lind & Ponack, L.L.P.

(57) ABSTRACT

A system for covering fasteners that are provided at an exterior building wall for mounting storm panels. The system includes cover plates that are located adjacent to the fasteners. The cover plates are mounted so as to be pivotable about one side of a mounting track. This permits the cover plates to pivot between a closed (use) position for covering the track and fasteners, and an open (non-use) position for permitting installation of storm panels. The cover plates can be painted in a variety of colors to match the building wall or the shutters, which permits the covers to blend into the exterior finish of the building. Thus, when the storm panels are removed, the present system conveniently covers the unattractive and conspicuous fasteners in an attractive manner.

20 Claims, 9 Drawing Sheets

U.S. PATENT DOCUMENTS 5,553,422 A * 9/1996 Gazaway ..... 52/204.53
5,572,843 A * 11/1996 Jordan ..... 52/410
5,620,037 A 4/1997 Apostolo
5,661,935 A * 9/1997 Erickson et al. ..... 52/202
5,740,639 A 4/1998 Covington
5,755,270 A * 5/1998 Knezevich et al. ..... 160/183
5,941,031 A * 8/1999 Fullwood ..... 52/202
6,029,405 A * 2/2000 Wood ..... 52/2.23
6,050,037 A * 4/2000 Gifford ..... 52/211
6,050,046 A * 4/2000 Rykaczewski ..... 52/718.01
6,079,168 A * 6/2000 Shaver ..... 52/202
6,148,895 A * 11/2000 Biggers ..... 160/183
6,216,399 B1 * 4/2001 Belarbi ..... 52/169.14
6,263,625 B1 * 7/2001 LaPointe ..... 52/202
6,279,641 B1 * 8/2001 Malott ..... 160/67
6,345,476 B1 * 2/2002 Hill ..... 52/202
6,381,915 B1 * 5/2002 Wood ..... 52/718.06
6,505,448 B1 * 1/2003 Ito ..... 52/474
6,546,681 B1 * 4/2003 Trundle ..... 52/202
6,708,457 B1 * 3/2004 Ballough ..... 52/202
6,755,231 B1 * 6/2004 Biggers ..... 160/183

* cited by examiner

SYSTEM FOR COVERING HURRICANE PANEL STUDS

This application claims the benefit of U.S. Provisional Application No. 60/288,648 filed May 4, 2001.

BACKGROUND OF THE INVENTION

1. Field of the Invention

The present invention relates to plates that cover mounting fasteners for hurricane shutters, and more particularly to plates that are designed to be stored about a window of a building and are easily moved into either a storage position or an in-use position over the fasteners.

2. Description of the Related Art

There are known arrangements that do not leave exposed studs, but unfortunately they do leave exposed bolt heads, or exposed tracks, or they fail to provide storage for the covers. The following patents are illustrative of these systems and are described below.

U.S. Pat. No. 2,012,388 to Goodman discloses a storm shutter having a frame or sash attached with hinges around a building opening and having protruding studs, and a panel with elongate ports to fit over the studs. A problem with Goodman is that the sash may prove unattractive and conspicuous when the shutter panels are not in use.

U.S. Pat. No. 4,215,517 to Everson discloses a storm window that can be installed inside of a window opening in a building wall. The storm window is mounted close to the existing window, which may be of different dimensions. The Everson arrangement includes plastic extrusions which are fastened inside the window, plastic panels that are connected to the extrusions and form a closure inside the window, and vertical and horizontal supports over the window. Note, when it is desired to mount the storm window outside of the window opening, a header and sill member (FIGS. 3–4 and 8–9) are mounted on the inside vertical surface. However, in this embodiment, the fastening screws are visible when the panels are not installed.

U.S. Pat. No. 4,620,503 to Pullens discloses "L" shaped masking mats about the sides of storm shutters. The masking mats slide in and close around the storm shutters to protect the walls of the house from becoming soiled or marked when cleaning, finishing, refinishing or painting variously sized rectangular storm shutters. The adjustable mats of the Pullens device cover the area about the periphery of the shutter, but it does not lend itself to covering studs for storm shutters as there is no room provided for the studs and no convenient mounting means for the covers.

U.S. Pat. No. 5,335,452 to Taylor discloses storm covers for doors and windows. The disclosed Taylor apparatus includes a panel for fitting a window opening, and a brace member extending across the panel member to secure the panel to the opening, and securing means for removably securing an end of the brace member. The securing means is removably secured to the building by anchors which are spaced apart. The disclosure of Taylor does provide storm shutters and recognizes the problem of exposed studs, however the solution disclosed in Taylor simply eliminates the studs for supporting the panels.

U.S. Pat. No. 5,620,037 to Apostolo discloses a shutter device for installation onto an exterior building wall over a window for hurricane protection. The Apostolo system comprises two tracks mounted horizontally on upper and lower portions of a window and a panel piece that slides between the two tracks and locks in place so as to completely cover the window. This system uses bolts to mount the tracks to the wall and the bolt heads are visible at all times. There is no covering plate for concealing the presence of the fastening bolts.

U.S. Pat. No. 5,740,639 to Covington is directed to a storm shutter installation which has a plurality of panels received in parallel channels near the upper and lower edges of a window. The upper and lower supports are aluminum extrusions that form channels for receiving and supporting the structural panels (see FIG. 2). The supports have mounting flanges for attaching the supports to a building wall. The flanges receive fasteners, which are always exposed, i.e. there are not covering plates provided for the fasteners.

SUMMARY OF THE INVENTION

It is an object of the present invention to provide a system that completely covers hurricane shutter mounting fasteners, in particular studs, when the fasteners are not in use and which easily moves away from the fasteners when the shutters are installed.

It is a further object of the present invention to provide cover plates for hurricane shutter mounting tracks and fasteners that lock in a position over the tracks when it is desired to conceal the shutter mounting system, and can be easily pivoted and locked in a position away from the shutter mounting system to allow access to the tracks and fasteners for installation of the hurricane panels.

The present invention is a system for covering the attachment tracks and studs that extend outwardly from the window frames for the purpose of mounting storm shutters. The system comprises cover plates, which are typically installed in a horizontal orientation above and below a window so as to extend along the width of the window. However, the tracks and cover plates can also be installed in a vertical orientation adjacent the sides of the window. The cover plates are hingedly mounted at one longitudinal edge of the track, which allows the cover plates to be pivoted away from the track and to pivot toward the track when it is desired to conceal the track and fasteners. The cover plates can be painted in a variety of colors to match the color scheme of the house and shutters. This system conveniently covers unsightly tracks and fasteners in an attractive manner.

The cover plates can be locked into either a covering (use) position or a storage (non-use) position with respect to the studs by means of cam surfaces formed on the hinge. This system includes stops on the hinge which limit the travel of the plates between the covering and storage positions.

BRIEF DESCRIPTION OF THE DRAWINGS

The drawing figures are briefly described as follows.

DETAILED DESCRIPTION OF THE INVENTION

Hurricane storm panels are used in many parts of the country to protect windows from flying debris during heavy storms. One of the most common type of hurricane panel is formed of corrugated steel, aluminum or lexan, and includes through holes to permit the panels to be mounted about a window frame by means of studs. Unfortunately, when the panels are not installed, the studs are exposed and appear similar to bullet holes in the side of the building, thereby detracting from the appearance of the building. The present invention provides a system for allowing the studs to be placed about the window to hold the storm panels and then to be concealed when the panels are removed.

Figure 1A:
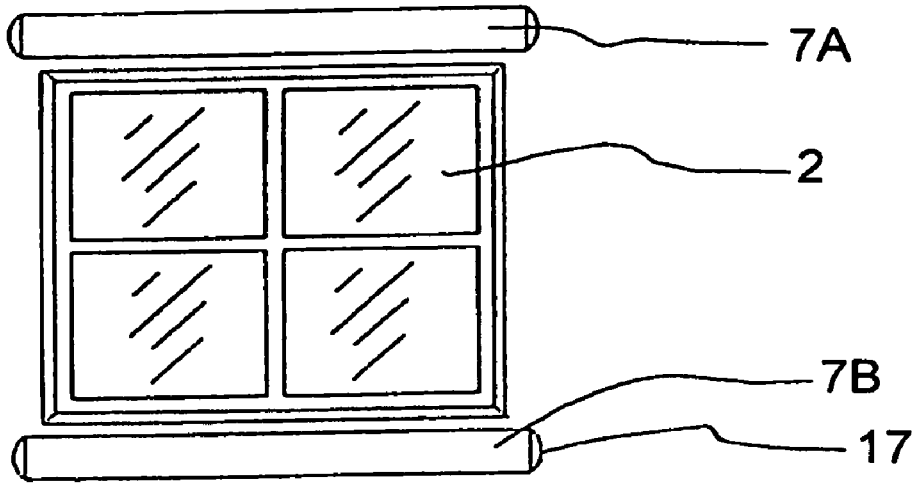
FIG. 1A is a front elevation view of a system for covering hurricane panel mounting studs provided about a window with the cover plates in a use position.
Figure 1B:
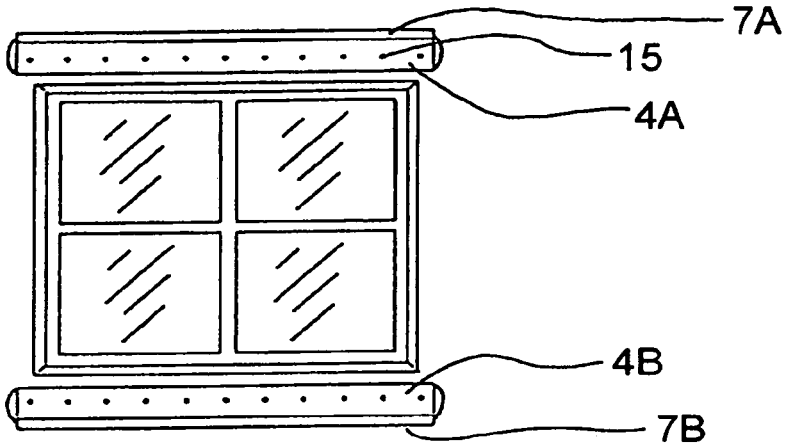
FIG. 1B is a front elevation view, which is similar to FIG. 1A except that the cover plates are in a non-use position.
Figure 2:
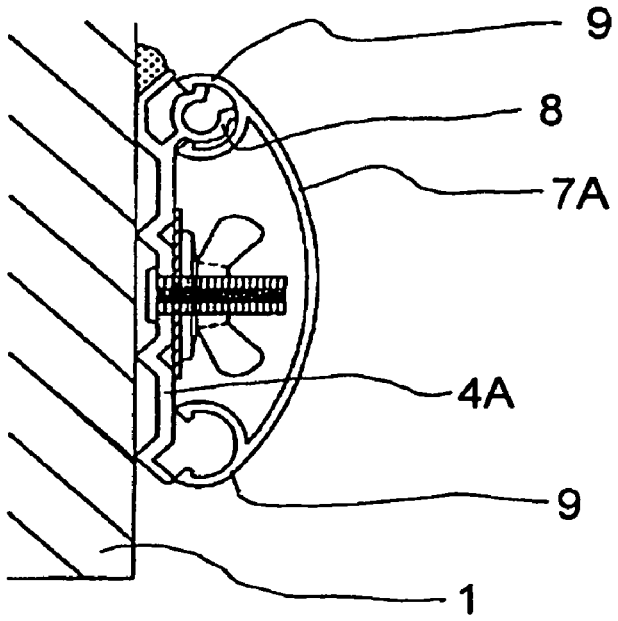
FIG. 2 is a side elevation view of the upper cover plate as shown in FIG. 1A.
Figure 3:
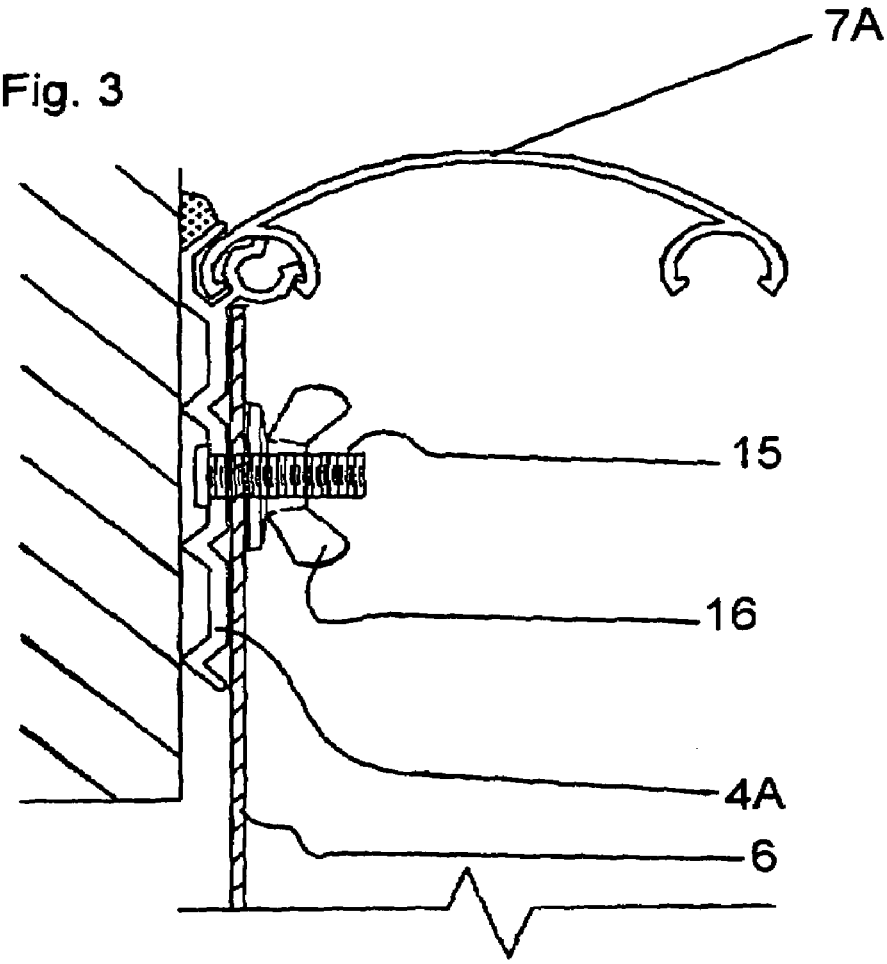
FIG. 3 is a side elevation view of the upper cover plate as shown in FIG. 1B.
Figure 4:
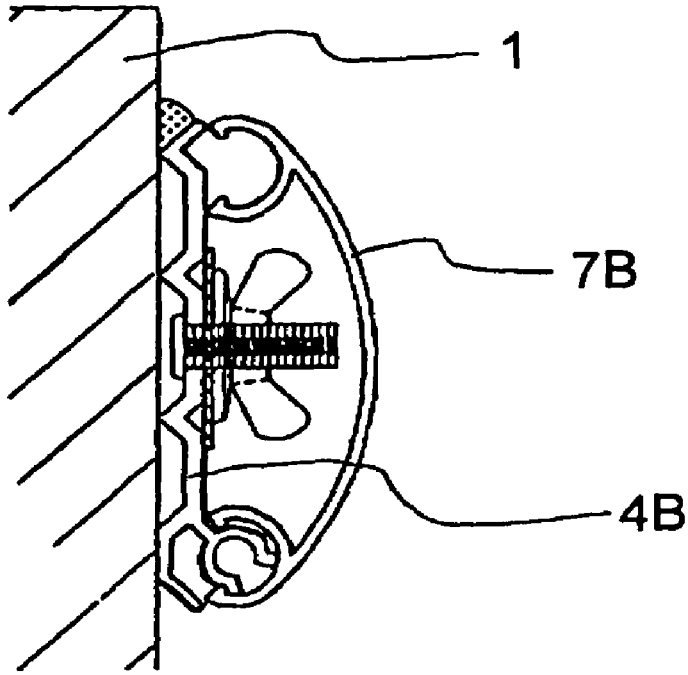
FIG. 4 is a side elevation view of the lower cover plate as shown in FIG. 1A.
Figure 5:
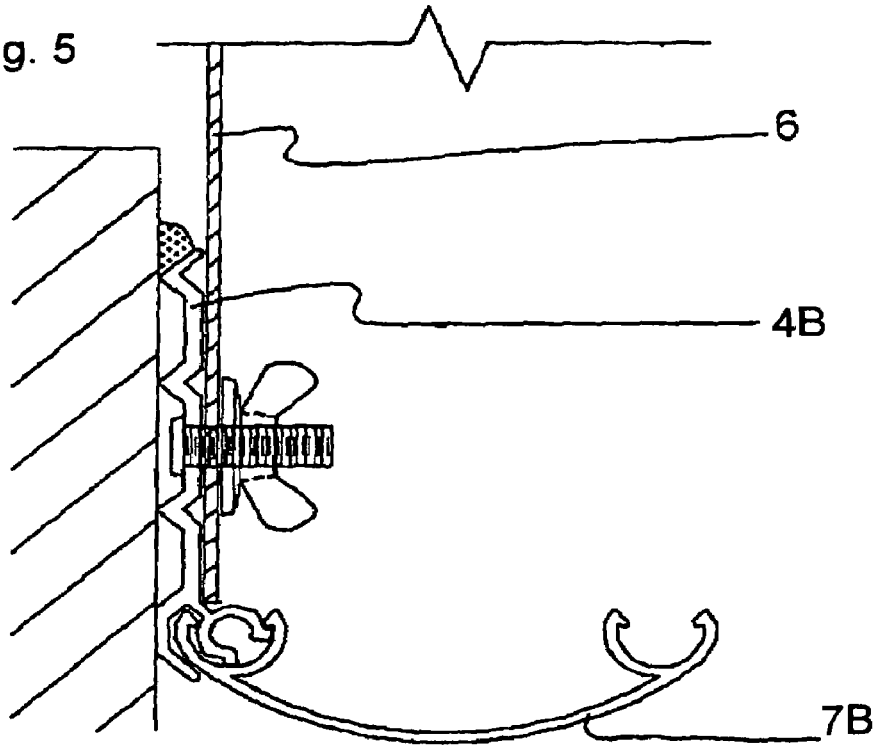
FIG. 5 is a side elevation view of the lower cover plate as shown in FIG. 1B.

FIG. 1A is a front elevation view showing the system of the present invention with upper and lower cover plates 7A, 7B deployed in a use (covering) position, and FIG. 1B shows the cover plates pivoted into a non-use position to expose panel fasteners (15, 16), which are provided in upper and lower mounting tracks 4A, 4B. In the non-use position, the cover plates extend generally in a perpendicular direction away from the building wall. As shown in FIGS. 2–3, the upper cover plate 7A is pivotally connected to an upper edge of the upper track 4A. And, as shown in FIGS. 4–5, the lower cover plate 7B is pivotally connected to a lower edge of the lower track 4B.

Figure 1C:
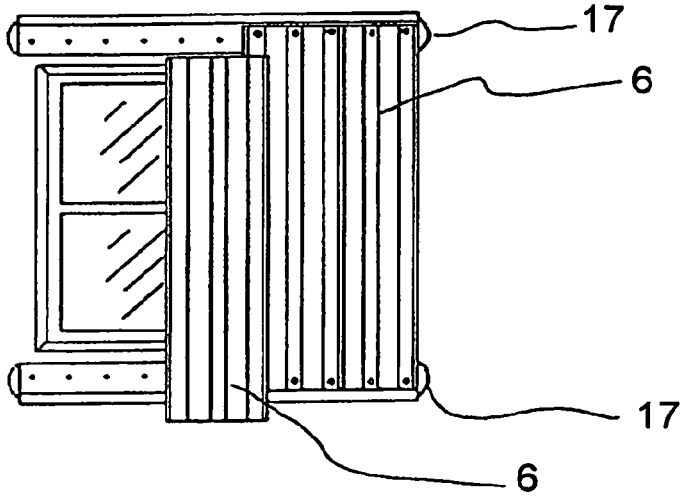
FIG. 1C is a front elevation view of the arrangement shown in FIG. 1B with hurricane panels partially installed.

FIG. 1C is a front elevation view of the window 2 with two hurricane panels 6 installed and a third panel positioned for installation over the window.

In the embodiment illustrated in FIGS. 2–5, each of the panel fasteners or fastening members include a stud 15 and a wing nut 16 for mounting the hurricane panels to the hurricane tracks 4A, 4B. Note that the panels or portions thereof may also be described as panel members. FIGS. 1A–1C illustrate the typical placement of hurricane panels and tracks about the window. However, the tracks can also be mounted in a vertical orientation adjacent the left and rights sides of the window.

A first track, such as track 4A, is mounted above the window while a second track, such as track 4B, is mounted below the window. Each of tracks 4A, 4B includes a male hinge member 8 disposed along a longitudinal edge of the track. The tracks may be formed of aluminum or other suitable material. Note that the tracks are designated "upper and lower" even though the structure of the tracks is substantially the same. However, as shown in FIGS. 2–5, the upper track 4A is mounted with the male hinge member 8 at an upper edge of the track, while the lower track 4B is mounted with the male hinge member 8 at a lower edge of the track.

Each track contains a row of studs, such as studs 15, which project orthogonally outward from the track and also out from the building when the tracks are installed thereon. The studs are preferably formed of stainless steel. The hurricane panels are preferably corrugated, and the portion of the corrugation in the panel that contacts the track contains holes through which the studs pass as the panels are pressed against the tracks. After a stud passes through a panel, a wing nut 16 is threaded onto the stud and tightened to hold the panel in place. Then, after the storm has passed, the panels are removed, which exposes the tracks and studs, as shown in FIG. 1B. This is the appearance that most typical hurricane panel installations leave once the hurricane panels have been removed. However, due to the construction of the present invention, the studs are quickly and simply removed from view by pivoting the cover plates 7A and 7B into the positions shown in FIGS. 1A, 2 and 4 to cover the unsightly studded tracks.

As can be seen in FIGS. 2–3, the upper cover plate 7A is attached to the upper track 4A along the upper edge of track 4A. This attachment is by way of a special hinge that permits the cover plate to remain in its non-use or outward orthogonal position with respect to the track, and then it can be snapped down into its use position to cover the studs, where it will remain until it is desired to raise the cover plate back to the non-use position. The lower cover plate is similar to the upper cover plate, only its positioned is reversed. The lower cover plate is attached to the lower track along its lower edge and is snapped upward to cover the studs on the lower track. The cover plates may be constructed of aluminum, plastic material, polyvinyl chloride (PVC) or any other suitable material.

FIGS. 8A–B and 9A–B show the details of the components of the hinge connection between the track and the cover plate. Note that only the lower track 4B and lower cover plate 4A are shown, however, as noted above, the upper and lower cover plates and tracks are identical except for their orientation.

FIGS. 2 and 4 show the cover in its closed position, covering the studded plates, while FIG. 4B shows the cover plate in its open or outwardly orthogonal position, leaving the stud 5C exposed. The cover plate follows an arcuate path when travelling between the open and closed positions.

Figure 6:
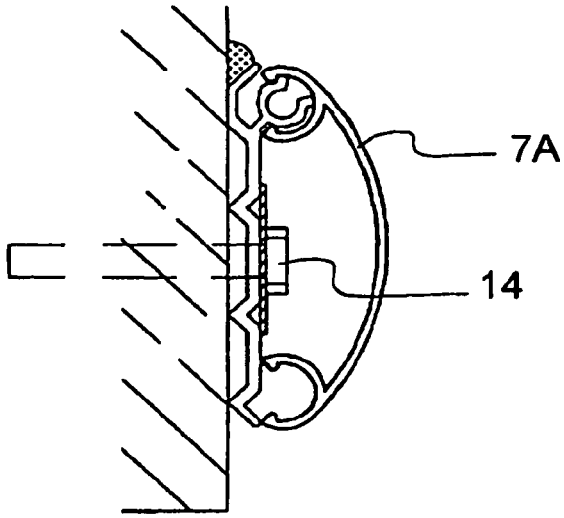
FIG. 6 is a side elevation view of an upper cover plate and track and the connection thereof to a building wall.
Figure 7:
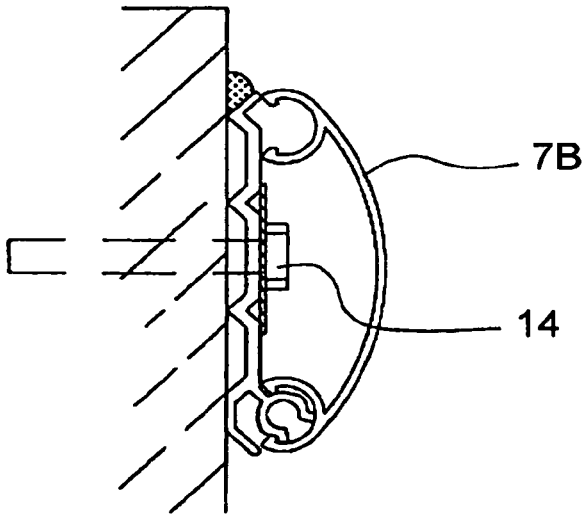
FIG. 7 is a side elevation view of a lower track connected to a wall of a building.
Figure 8A:
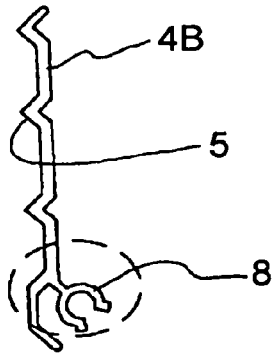
FIG. 8A is a cross sectional view of the track shown, e.g., in FIG. 4.
Figure 8B:
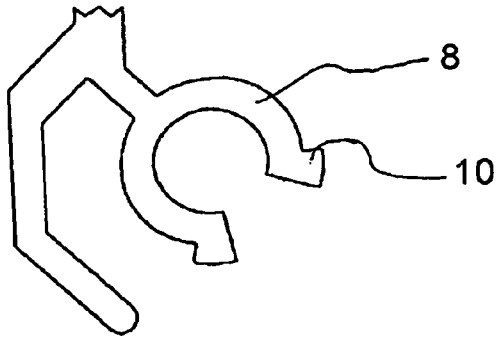
FIG. 8B is an enlarged cross sectional view of a male hinge member of the track shown in FIG. 8A.
Figure 9A:
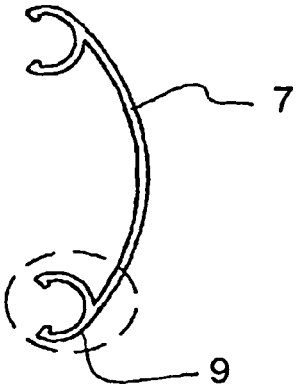
FIG. 9A is a cross sectional view of the cover plate shown, e.g., in FIG. 4.
Figure 9B:
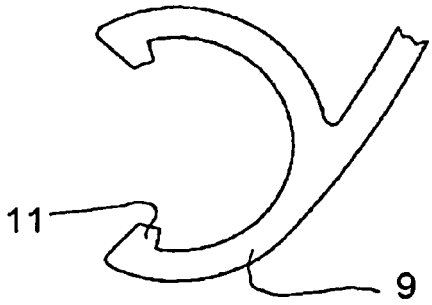
FIG. 9B is an enlarged cross sectional view of a female hinge member of the cover plate shown in FIG. 9A.

The track is a plate which has several longitudinal ribs on one side, such as stand-off ribs 5 that function to space the track away from the building surface, thereby providing sufficient space to accommodate the heads of the studs 15. As shown in FIGS. 6–7, the track is typically mounted to the building wall by driving fasteners 14 through holes in the track and into the wall. The type of fastener will be determined by the material forming the building wall.

As indicated above, the tracks 4A, 4B are connected the cover plates 7A, 7B by means of a hinge formed of a female hinge member or connecting member 9, attached to the cover plate, and a male hinge member or connecting member 8, attached to a longitudinal edge of the track. Both hinge portions are approximately semi-circular in cross section. Further, at the open ends of the semi-circular sections are radial projections referred to as stops. The male hinge member 8 is formed with stop projections 10 that are directed radially outward, while the female hinge member is formed with stop projections 11 that are directed radially inward.

As the cover plate is pivoted, the corresponding stop projections 10, 11 will engage to prevent the cover plate from going beyond the open or the closed positions. In addition, the outer peripheral surface of the male hinge member increases in diameter near the stops. These increased diameter portions cooperate with the stops on the female member to sufficiently lock or hold the cover plate in its open or closed position until this interference is intentionally overridden by manual force. Upon application of sufficient force, the stops on the female hinge will slightly deform so as to ride over the enlarged diameter portions on the male hinge member.

As shown in FIGS. 1A–1C, each of the tracks 4A, 4B is provided with end caps 17, which provide the cover plate with an even more finished appearance. Although the caps are shown on the tracks, they can also be connected to the cover plates 7A, 7B.

The present invention may be embodied in other specific forms without departing from the spirit or essential characteristics thereof. For example, a conventional hinge may be used with external stops and locks, and the components of the disclosed hinge could be reversed. Also, the cover plate may be connected to the track by means of alternate coupling arrangements. In particular, instead of the hinge connection, the cover place may be snap-fastened over the studded plate by snaps that grip the upper and lower edges of the plate. Alternatively the upper and lower edges of the cover plates may be slid behind the projections on the outward face of the tracks. Accordingly, the illustrated embodiment should be considered in all respects as illustrative and not restrictive, and reference should be made to the appended claims rather than to the foregoing description to indicate the scope of the invention.

I claim:

1. A storm shutter mounting apparatus comprising:

a track having a connecting member at a longitudinal edge of the track;

a plurality of fastening members extending through said track, each of said fastening members being adapted to receive and hold a rigid panel member against said track; and a cover plate movably coupled to said track so that said cover plate can be moved relative to said track between a first position covering said track and said fastening members and a second position exposing said track and said fastening members to permit attachment of the rigid panel member to said track.

2. The apparatus as claimed in claim 1, wherein each of said fastening members comprises a stud and a wing nut.

3. The apparatus as claimed in claim 1, wherein said cover plate is formed of aluminum.

4. The apparatus as claimed in claim 1, wherein said cover plate is formed of polyvinyl chloride.

5. The apparatus as claimed in claim 1, wherein said cover plate is formed of plastic.

6. The apparatus as claimed in claim 1, wherein said cover plate is pivotally connected to said track.

7. The apparatus as claimed in claim 1, wherein said cover plate extends substantially along the entire length of said track.

8. The apparatus as claimed in claim 1, wherein said track is a generally planar strip.

9. A storm shutter mounting apparatus comprising:

a track having a male hinge member disposed along a longitudinal edge of said track;

a plurality of studs extending through said track, wherein said studs project from said track to permit a rigid panel member to be received thereon and held on said track; and a cover plate having a female hinge member disposed along a longitudinal edge of said cover plate, wherein said male hinge member is received in said female hinge member to permit said cover plate to pivot between a first position at which said cover plate extends generally perpendicularly from said track and a second position at which said cover plate covers said track and said studs.

10. The apparatus as claimed in claim 9, wherein each of said male and female hinge members are approximately semi-circular in cross section, and stop projections are formed at the ends of the semi-circular sections of said male and female hinge portions.

11. The apparatus as claimed in claim 10, wherein said stop projections on said male hinge member are directed radially outward, and said stop projections on said the female hinge member are directed radially inward.

12. The apparatus as claimed in claim 11, wherein said male hinge member includes an outer peripheral surface that defines increased diameter portions which cooperate with said stop projections on said female hinge member to lock said cover plate in the first and second positions.

13. The apparatus as claimed in claim 9, wherein said track includes a plurality of longitudinally extending ribs for engaging a building wall.

14. The apparatus as claimed in claim 9, wherein said cover plate extends along the entire length of the longitudinal edge of said track.

15. The apparatus as claimed in claim 9, wherein said track is a generally planar strip.

16. A storm shutter mounting system comprising:

an upper track having a male hinge member disposed along an upper longitudinal edge of said upper track;

a plurality of studs extending through said upper track;

an upper cover plate having female hinge members disposed along the upper and lower longitudinal edges of said upper cover plate, wherein said male hinge member is received in said female hinge member disposed along the upper longitudinal edge of said upper cover plate to permit said upper cover plate to pivot between a first position at which said upper cover plate extends generally perpendicularly from said upper track and a second position at which said female hinge member disposed along the lower longitudinal edge is adjacent a lower longitudinal edge of said upper cover plate;

a lower track having a male hinge member disposed along a lower longitudinal edge of said track;

a plurality of studs extending through said lower track, wherein said studs extend through said upper and lower tracks and project outwardly therefrom for receiving thereon a rigid shutter panel;

a lower cover plate having female hinge members disposed along the upper and lower longitudinal edges of said lower cover plate, wherein said male hinge member of said lower cover plate is received in the female hinge member disposed along the lower longitudinal edge of said lower cover plate to permit said lower cover plate to pivot between a first position at which said lower cover plate extends generally perpendicularly from said lower track and a second position at which said female hinge member disposed along the upper longitudinal edge is adjacent an upper longitudinal edge of said lower cover plate.

17. The apparatus as claimed in claim 16, wherein each of said male and female hinge members are approximately semi-circular in cross section, and stop projections are formed at the ends of the semi-circular sections of said male and female hinge portions.

18. The apparatus as claimed in claim 17, wherein said stop projections on said male hinge members are directed radially outward, and said stop projections on said the female hinge members are directed radially inward.

19. The apparatus as claimed in claim 18, wherein each of said male hinge members includes an outer peripheral surface that defines increased diameter portions which cooperate with said stop projections on said corresponding female hinge member to lock said cover plates in the first and second positions.

20. The apparatus as claimed in claim 16, wherein each of said upper and lower tracks is a generally planar strip.

* * * * *